United States Patent [19]

Schwartz

[11] 4,314,593

[45] Feb. 9, 1982

[54] HAMMER WITH SELECTIVELY ACTUATED AUXILIARY HEAD

[76] Inventor: Boris Schwartz, 625 Lafayette Ave., Hawthorne, N.J. 07506

[21] Appl. No.: 167,135

[22] Filed: Jul. 9, 1980

[51] Int. Cl.[3] ..... B25C 1/00

[52] U.S. Cl. ..... 145/29 R

[58] Field of Search ..... 145/29 R, 30 R

[56] References Cited

U.S. PATENT DOCUMENTS

| | | | |
|---|---|---|---|
| 163,907 | 6/1875 | Alger | 145/29 R |
| 176,333 | 4/1876 | McWilliams | 145/30 R |
| 304,618 | 9/1884 | Cullen | 145/30 R |
| 1,341,373 | 5/1920 | Komatar | 145/29 R |

FOREIGN PATENT DOCUMENTS

| | | | |
|---|---|---|---|
| 232168 | 3/1911 | Fed. Rep. of Germany | 145/29 R |

*Primary Examiner*—Stephen G. Kunin
*Assistant Examiner*—J. T. Zatarga
*Attorney, Agent, or Firm*—Ralph R. Roberts

[57] ABSTRACT

This invention pertains to a hammer with a swinging auxiliary head which is used to impart a second imputus or force to the first and fixed head. This auxiliary head is pivotally mounted in a fixed bracket and is restrained in its movement by a ball detent and/or a U or J-clip which limits the swing or selectively holds the two heads together in a contiguous relationship. A spring actuated lever control device is also shown for compressed spring propulsion of the auxiliary head. Two embodiments are also shown for combining the ball detent, spring actuation and holding the two heads in fixed together arrangement. Each apparatus may be employed with conventional rear portions of hammers such as nail pulling claws and ball peen configurations.

20 Claims, 11 Drawing Figures

HAMMER WITH SELECTIVELY ACTUATED AUXILIARY HEAD

BACKGROUND OF THE INVENTION

1. Field of the Invention

With reference to the field of art as established in and by the United States Patent Office, the present invention is believed to be found in the General Class entitled, "Woodworking Tools" (Class 145) and more particularly in the subclass entitled, "hammers" (subclass 29 R).

2. Description of the Prior Art

Hammers are, of course, well known as they are probably one of the oldest implements used by man. The present array of hammers include ball-peen hammers as used by mechanics, claw hammers with nail pulling appliances and wrenches with hammer head portions. Hammers with heavy heads and the like or driving capabilities with plural faces are also known. Some attempts to provide an auxiliary drive have been devised. A careful pre-ex search was made in the above identified field of art but as far as could be determined in this careful study of the known hammers there was no provision of a hammer having an auxiliary striking capability. This auxiliary head is pivotally retained in a novel manner and this capability has a controlled release.

Although hammers are well known, a pre-ex search did not disclose hammers with auxiliary heads that can be precisely controlled as to the limit of swing, a detent so that the head is not actuated until the moment of impact or a locking together capability and last but not least, the actuation of the auxiliary head by spring actuated means. In the course of this search the following were noted: U.S. Pat. No. 148,240 to PECK of Mar. 3, 1874; U.S. Pat. No. 163,907 to ALGER on June 1, 1875; U.S. Pat. No. 327,131 to BRANDON on Sept. 20, 1885; U.S. Pat. No. 1,341,373 to KOMATAR on May 25, 1920 and Germany 232,168 on Mar. 9, 1911 to A HUNGER. These references do not show or teach the controlled auxiliary head of the present invention.

SUMMARY OF THE INVENTION

This invention may be summarized, at least in part, with reference to its objects. It is an object of this invention to provide, and it does provide, a hammer with a pivoted auxiliary head that is selectively actuated to provide a secondary striking impetus.

It is an object of this invention to provide, and it does provide, a hammer having an auxiliary pivoted head portion that may be actuated with a striking motion and with the stop action of the front head portion the secondary head is carried forwardly to provide a secondary strike force.

In brief, this hammer has a head which is less than the conventional configuration. Hingedly mounted to the handle portion is an auxiliary head portion. This auxiliary portion may have a claw for removing nails and the like. This pivoted portion may have a ball detent to maintain the auxiliary head portion in an apart condition until the initial engagement of the front head against a nail or the like occurs. As the initial striking motion is terminated the stored energy in this second head portion is released to impart a further driving or striking input to the front head.

The hammer is provided with means to lock the auxiliary head to the front head so that the initial and full impact can be made in a conventional manner.

There is also shown apparatus whereby the auxiliary head is moved by an impulse spring. With this arrangement the front head may be or is placed in position on the nail or item to be struck and the trigger apparatus is s squeezed to cause the spring to be compressed and the auxiliary head to be moved by the spring to a released condition whereat and whereby the auxiliary head is rapidly moved by the spring to strike the front head.

The front head is contoured at its rear face to provide a receiving recess. The auxiliary head is pivotally mounted so that the front portion strikes and is seated in the contoured rear face of the forward head portion.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a hammer with a selectively actuated auxiliary head as adopted for use in driving nails and the like and showing a preferred means for pivotally supporting the auxiliary head. This specific embodiment has been chosen for the purposes of illustration and description as shown in the accompanying drawings wherein:

Brief Description of the Drawings

FIG. 2 B represents a diagrammatic plan view of the U-clip used with this arrangement;

FIG. 6 B represents a fragmentary top or plan view and further showing novel components of FIG. 6 A;

In the following description and in the claims various details are identified by specific names for convenience. These names are intended to be generic in their application. Corresponding reference characters refer to like members throughout the several figures of the drawings.

DESCRIPTION OF THE EMBODIMENT OF FIGS. 1, 2 A AND 2 B

Figure 1:
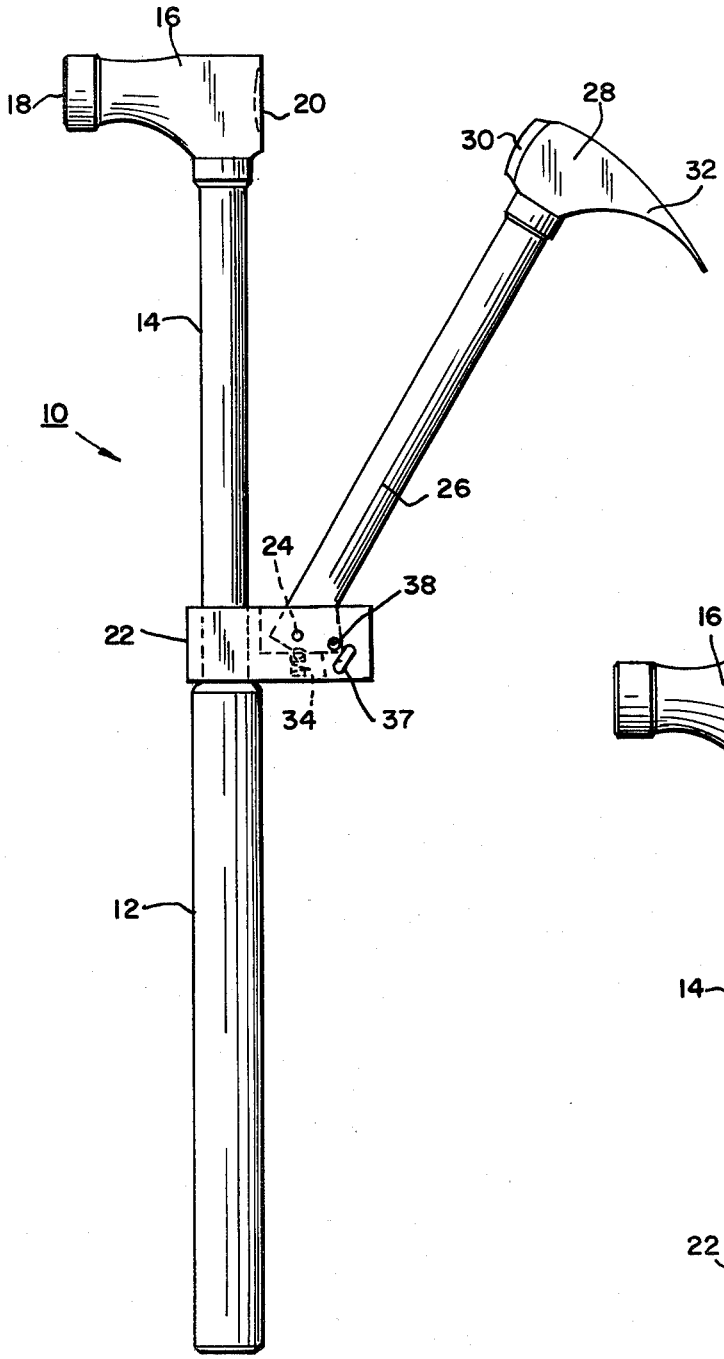
FIG. 1 represents a side view, partly diagrammatic and showing a hammer with an auxiliary head disposed in the apart condition prior to striking.
Figure 2B:
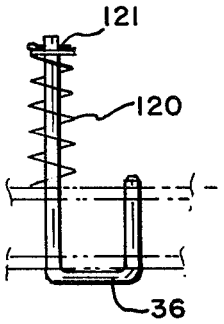
FIG. 2 A represents a partially fragmentary side view of the two head portions in a locked condition.
Figure 2A:
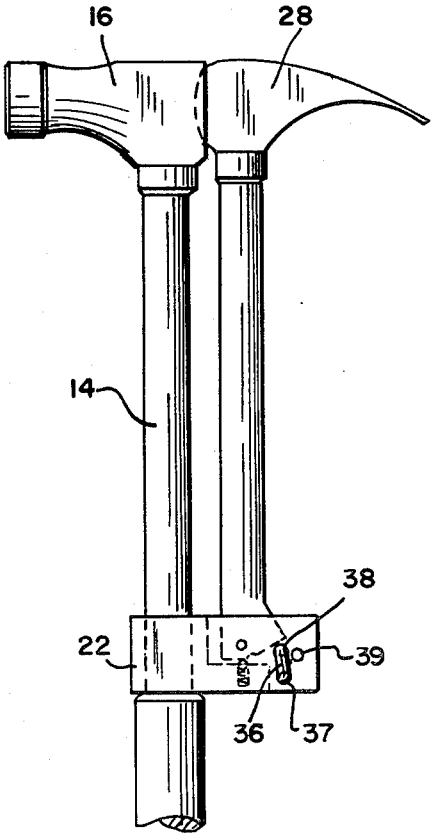

Referring next to the drawings and in particular to FIGS. 1, 2 A and 2 B, the hammer of this invention is shown to illustrate its operating capabilities. The illustration of a hammer is partly diagrammatic since hammers are made with many shapes of handles as well as heads. Among the head styles are claw hammers with both straight and curved claws. Ball peen hammers are also known but the embodiment shown may be used with any known capability.

As depicted, the hammer is generally identified as 10, with the handle as 12. Above the handle is shank portion 14 which is preferably of metal. A head portion 16 has the front striking end 18 of conventional shape and purpose. The head 16 is, of course, fixed securely to the shank portion 14. The head 16 has its rear portion formed with a receiving cup portion 20 which as depicted is just to the rear (right) of the shank connection to the head.

A hinge bracket 22 is shown as secured to the shank 14 but this hinge may be formed as a part of the shank. As shown, this hinge includes a pivot pin 24 which supports and secures an auxiliary shank 26. This shank portion 26 carries an auxiliary head 28 which is shown as having a resilient face portion 30 and a curved claw portion 32. A ball detent 34 is disposed in the hinge bracket 22 and is adapted to retain the auxiliary head 28 in the position of FIG. 1 until the head 16 has engaged that nail or the like being struck. When the head 16 is stopped by the striking contact the auxiliary head 28 continues to move forwardly and the ball detent 34 is overcome and the auxiliary head moves forward to give a second driving action to head 16.

The hammer of FIG. 1 is shown in FIG. 2 with the auxiliary head 28 in a locked and closed condition whereat said auxiliary head is moved and locked with the head 28 secured to the shank of the hammer. As shown, this auxiliary head is locked in position by U-clip 36. This U-clip has one leg mounted in hole 37 formed in the hinge bracket 22. The other leg of said U-clip 36 is mounted in hole 38 and engages the downward end of the auxiliary shank 26 so as to retain this auxiliary head in the condition and position of FIG. 2. When and as the U-clip 36 is mounted in hole 37 and limiting hole 39 the head 28 may move in a pivotal manner to the limit of arc as noted in FIG. 1. The ball detent 34, carried in this bracket 22, prevents movement of the auxiliary head 28 until a completed swing has been made.

It is very desirable that said auxiliary head be restrained during use of the hammer so that unwanted movement of this auxiliary head does not occur. The ball detent 34 shown is one inexpensive concept and the use of a U-clip 36 also provides a means for retaining the auxiliary head at the desired limit of movement. The resilient face portion 30 provides sound and shock deadening means. The limit of swing is also a matter of choice. It is to be noted that rather than the ball detent 34 shown a magnet instead or in addition thereto is also contemplated. Controlled movement and limit of the auxiliary head 28 is very desirable.

Figure 3:
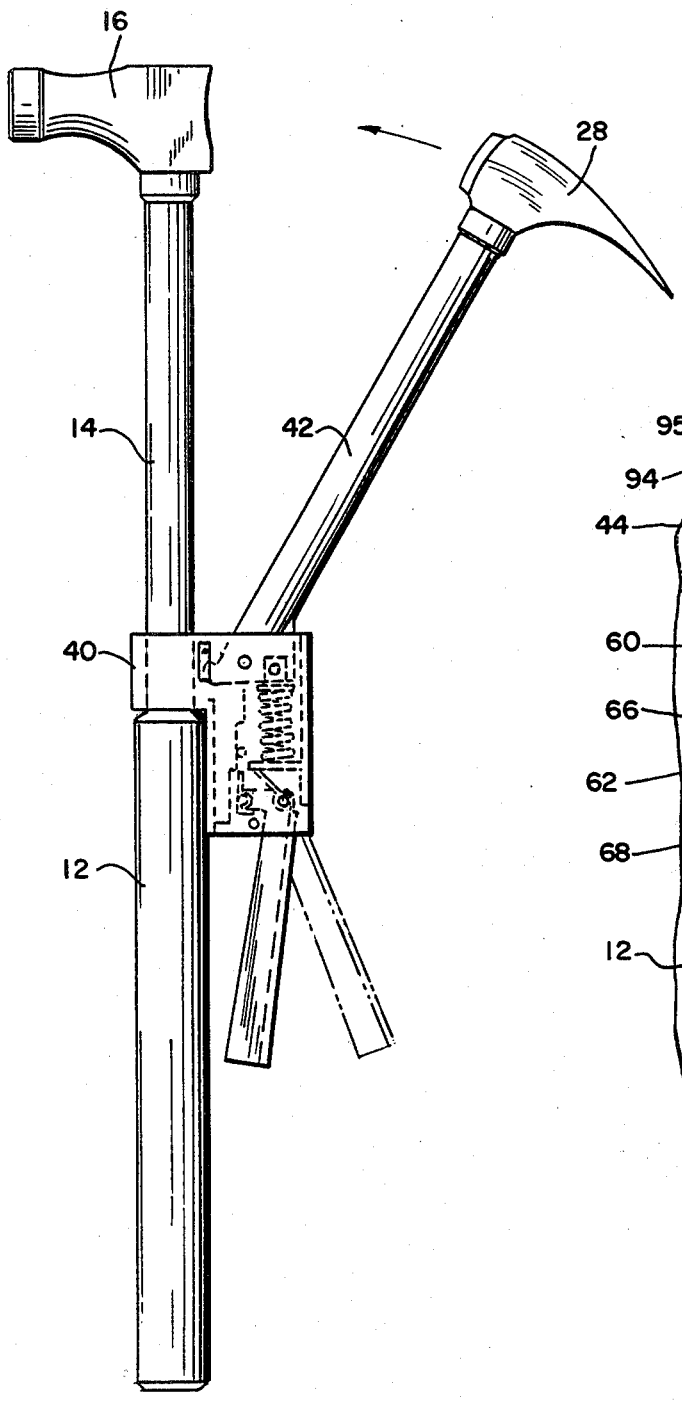
FIG. 3 represents a side view of an alternate construction of the hammer of FIG. 1, with this embodiment having a spring drive for actuating the auxiliary head.
Figure 4:
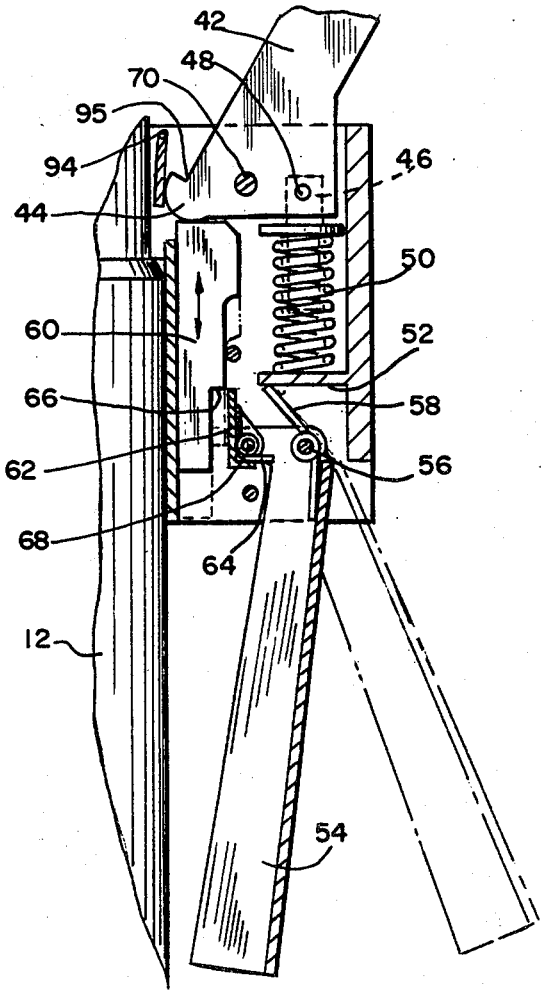
FIG. 4 shows a side view, partly diagrammatic and in an enlarged scale of the spring actuated mechanism for moving the auxiliary head.

Spring Actuated Apparatus of FIGS. 3 and 4

The hammer of FIG. 1 may also be swung by a spring actuated mechanism. A depicted embodiment, as shown in FIGS. 3 and 4, includes the handle 12, the shank 14, the head 16 and the auxiliary head 28, similar to that shown in FIG. 1. Around said shank 14 is secured a bracket 40 which pivotally retains the auxiliary head 28 which is mounted on a slightly different shank portion 42. This shank has a forward or left inner end formed with an arcuate portion 44. The right end is actuated by a clevis end 46 and a pivot pin 48. This clevis end 46 retains the upper end of a compression spring 50 and the lower end of this spring is mounted on and is secured to a protruding shelf portion 52 of bracket 40.

A handle 54 is pivotally secured to a pivot pin 56 carried in the bracket 40. Also mounted on this pivot pin 56 is a torsion spring 58 which urges handle 54 to the open or right position. A slide member 60 is carried at the left portion of the bracket 40. This slide member 60 moves in the direction as shown by the arrows. A pawl 62 is carried by the front portion of the handle 54. A torsion spring 64 is disposed so that the pawl 62 is urged toward the slide and into engagement with step 66 formed in the slide 60. This pawl 62 is hingedly carried by pin 68 on the handle 54. The auxiliary hammer head 28 is carried by the shank portion 42 on a pivot pin 70 which extends through and is secured to apertures formed in bracket 40.

Use and Operation

To use this pivotally secured handle 54, which is the trigger release, it is realized that the auxiliary head 28, when the handle is moved to the left position, causes said auxiliary head 28 to swing into the condition of FIG. 3. The squeezing of the pivoted handle 54 towards the handle 12 causes the pawl 62 to engage the step 66 and push the slide member 60 upwardly. As it is pushed upwardly the auxiliary head 28 swings back and spring 50 is compressed. This backward movement continues as the handle 54 is moved towards the handle 12 until said handle 54 reaches a release point at which point spring 50 has been compressed to a limit extent. As the handle 54 is squeezed the pawl 62 moves the slide member 60 upwardly. The torsion spring 64 urges pawl 62 into engagement with step 66 until the handle 54 is moved adjacent to the handle 12 as seen in FIG. 3. At this point the pawl 62 is pulled from in way of the step 66 releasing the slide member 60. The compressed spring 50 now urges the auxiliary head 28 forwardly. It is to be noted that the pawl torsion spring 64 keeps the pawl 62 against the step 66 until after the handle rotates approximately thirty degrees. When the pawl 62 is disengaged from the step 66 the spring 50 causes the auxiliary head 28 to swing forwardly to impact the fixed head 16 and with this action causes an impact or striking force to be asserted. It is, of course, to be noted that the hammer can be positioned with the head portion 16 against the nail or other member to be driven. Repeated squeezing of the handle 54 can then cause a striking of the auxiliary head 28 at any desired rate by squeezing of the handle 54.

Figure 5:
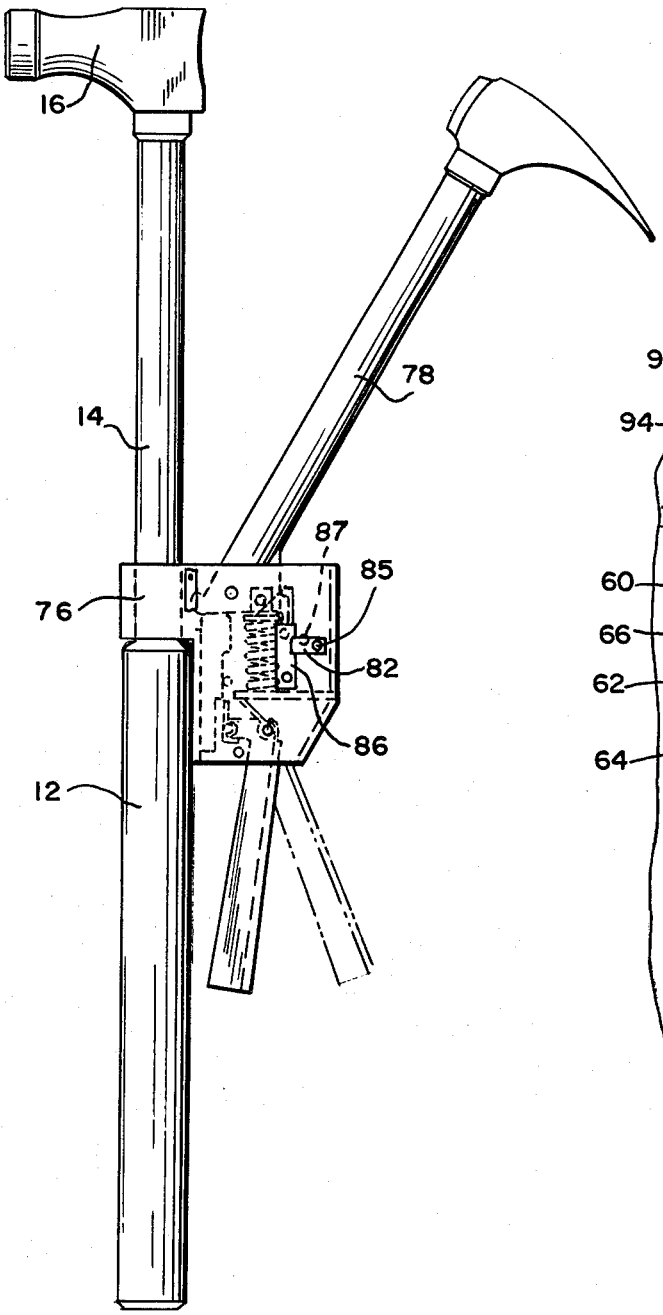
FIG. 5 represents a side view, partly diagrammatic, of a hammer with a lever actuated and spring propelled apparatus similar to FIGS. 3 and 4 and including a spring detent and lock capability.
Figure 6B:
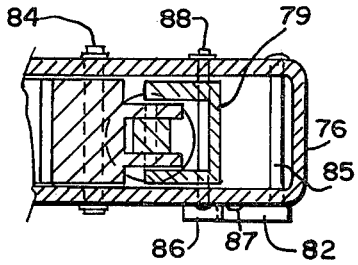
FIG. 6 A represents, in an enlarged scale and in a partly sectional side and diagrammatic view, the apparatus of FIG. 5.
Figure 6A:
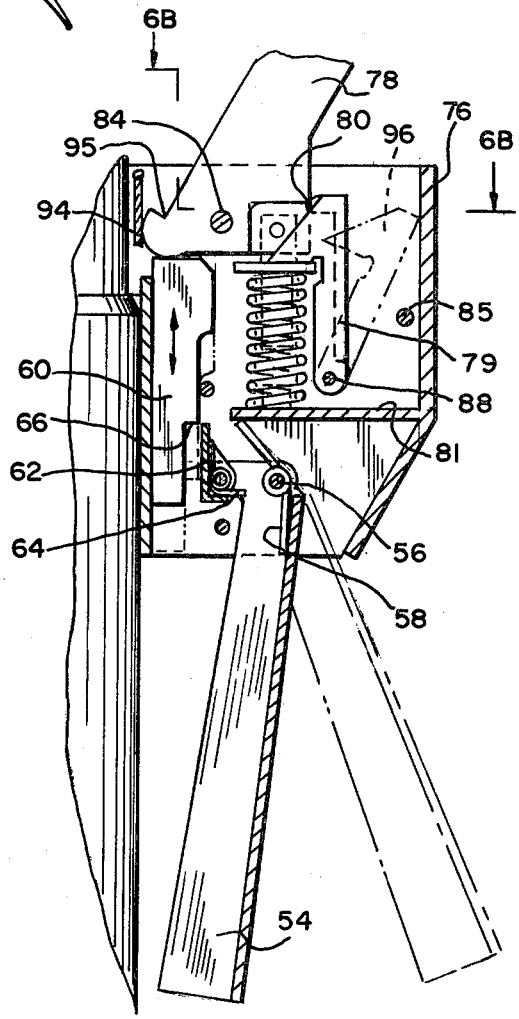

Embodiment of FIGS. 5, 6 A and 6 B

Referring next to FIGS. 5, 6 A and 6 B, the hammer of FIGS. 1 and 3 have been combined to achieve a means of control of these two embodiments. The combination capability of this showing is a little more expensive than separate embodiments. As shown, the hammer handle 12, shank portion 14 and head portion 16 are much alike or identical to that of FIGS. 3 and 4 above discussed. Around said shank 14 is secured a bracket 76 which pivotally retains the auxiliary head 28 which is mounted on a slightly different shank portion 78. This shank has a forward or left inner end formed with an arcuate portion 80. The right end is actuated by a clevis end 46 and a pivot pin 48. This clevis end 46 retains the upper end of a compression spring 50 and the lower end of this spring is mounted on and is secured to a protruding shelf portion 81 of bracket 76.

A handle 54, as seen in FIG. 3, is pivotally secured to a pivot pin 56 carried in bracket 76. Also mounted on this pivot pin 56 is a torsion spring 58 which urges handle 54 to the open or right position. A slide member 60, as seen in FIG. 3, carried at the left portion of bracket 76 moves in the direction as shown by the arrows. Pawl 62 is carried by the front portion of the handle 54 and torsion spring 64 is disposed so that the pawl 62 is urged toward the slide member and into engagement with step 66 formed in the slide 60. Pawl 62 is hingedly carried by pin 68 on the handle 54. The auxiliary hammer head 28 is carried by the shank portion 78 on a pivot pin which extends through and is secured to apertures formed in bracket 76.

As depicted, the bracket 76 has means for manipulation of a detent protrusion which is formed and carried by a bar 79. The auxiliary shank portion 78 has small arcuate portion 80 formed at the right side and lower end thereof. This shank is adapted to be restrained by this detent actuation when the auxiliary head 28 is swung to the back condition of FIG. 5. This bar 79 is retained in position by means of small pivot arm 82 which is carried on shaft 85 and retained by dimple 87. The swinging of bar 79 is by an actuating lever 86 which is mounted on an extension of shaft 88. Swinging the bar 79 into an outer position frees the shank 78. The resiliency of the bar 79 may provide the detent actuation or a spring may be provided in the actuation and in the lock by pivot arm 82 when it is swung into position. When it is desired to have the auxiliary head 28 swung into a contiguous condition said heads 16 and 28 are brought and retained together by means provided by lever 90 carried by shaft 92 and locking member 94 moved into a notch 95. Also to be noted, when the bar 79 is swung into position by means of the actuating lever 86 a lock fork 96 is swung into position to prevent further actuation of a spring 50.

Use and Operation

To use, pivotally secured handle 54, when moved to the left position, causes said auxiliary head 28 to swing into the condition of FIG. 5. The squeezing or moving of the pivoted handle 54 towards the handle 12 causes the pawl 62 to engage step 66 and push the slide member 60 upwardly. The upward movement of slide 60 causes the auxiliary head 28 to swing back and spring 50 is compressed. This backward movement continues as the handle 54 is moved towards the handle 12 until said handle 54 reaches a release point at which point spring 50 has been compressed to a determined extent. As the handle 54 is squeezed pawl 62 moves the slide member 60 upwardly with torsion spring 64 urging pawl 62 into engagement with step 66 until the handle 54 is moved adjacent to the handle 12 as seen in FIG. 5. At this position the pawl 62 is pulled from in way of the step 66 releasing the slide member 60. The compressed spring 50 now urges the auxiliary head 28 forwardly. It is to be noted that the pawl torsion spring 64 keeps the pawl 62 against the step 66 until after the handle 54 rotates approximately thirty degrees. When the pawl 62 is disengaged from the step 66 the spring 50 causes the auxiliary head 28 to swing forwardly to impact the fixed head 16.

Figure 7:
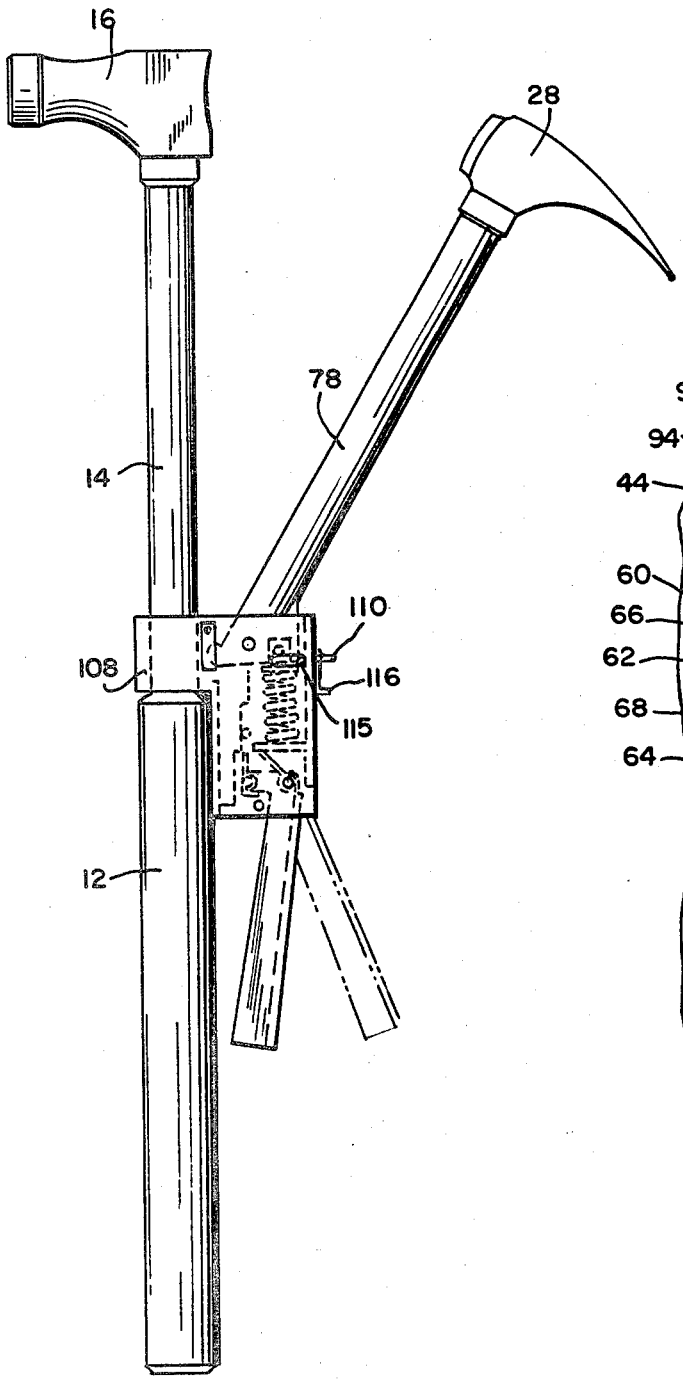
FIG. 7 represents a side view of apparatus very similar to that of FIG. 5 but employing an alternate mechanism for limiting the movement of the auxiliary head.
Figure 8B:
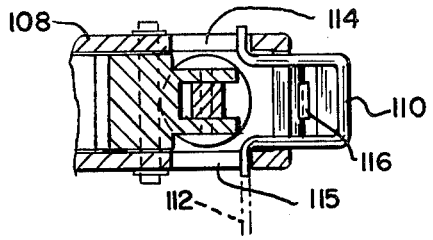
FIG. 8 A represents an enlarged side view like that of FIG. 6 A with a diagrammatic showing of the apparatus of FIG. 7, and FIG. 8 B represents a fragmentary top or side view and further showing several of the control elements of the mechanism of FIG. 8 A.
Figure 8A:
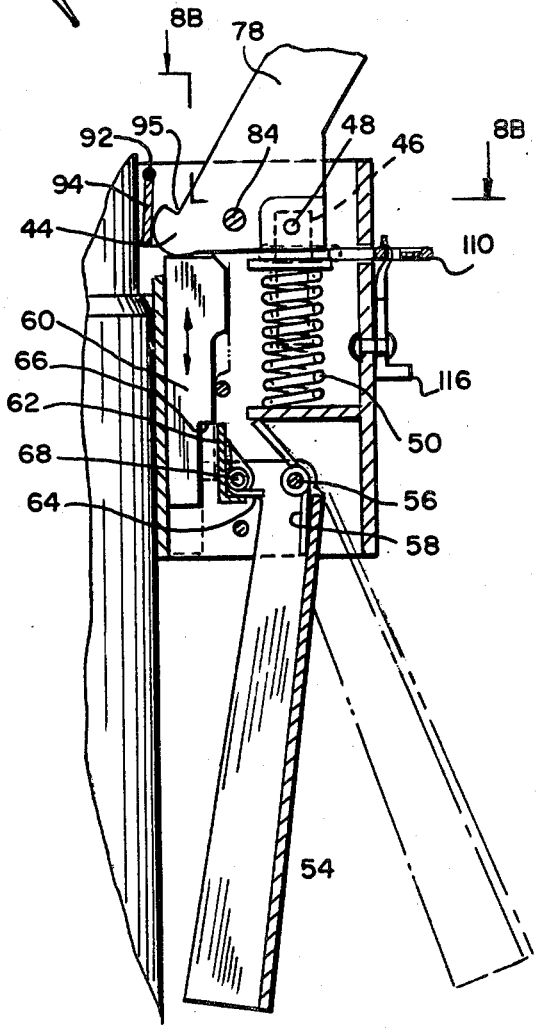

Embodiments of FIGS. 7, 8 A and 8 B

Referring now and finally to FIGS. 7, 8 A and 8 B, it is to be noted that an alternate means is provided for the actuation and retention of the auxiliary head 28. Bracket 108 encloses most of the mechanism and is shown as secured to the shank of the hammer. In this embodiment a clip or cross bar 110, which may be made as a wire form, has an extending protrusion 112. This bar 110 is carried in slots 114 and 115 formed in the side walls of the bracket 108. A spring clip 116 is carried on the back of the bracket 108 and may be retained in place by rivets or other sliding guide means. This clip may be spring loaded if desired. When slid into position the bar 110 restrains the spring 50 from moving upwardly. This allows the auxiliary head 28 to be moved into a locked condition by means of a lock apparatus 90, 92 and 94 as above described.

The handle 12, the shank 14, the head 16 and the auxiliary head 28 are similar to that shown in FIG. 1. To shank 14 is secured a bracket which pivotally retains the auxiliary head 28 which is mounted on a shank portion. This shank has a forward or left inner end formed with an arcuate portion 44. As in FIG. 4, the right end is actuated by clevis end 46 and a pivot pin 48. This clevis end 46 retains the upper end of compression spring 50 and the lower end of this spring is mounted on and is secured to a protruding shelf portion.

Handle 54 is pivotally secured to a pivot pin 56 carried in the bracket. Also mounted on this pivot pin 56 is torsion spring 58 which urges handle 54 to the open or right position. Slide member 60 moves in the direction as shown by the arrows. Pawl 62 is carried by the front portion of the handle 54. Torsion spring 64 is disposed so that the pawl 62 is urged toward the slide and into engagement with step 66 formed in the slide 60. This pawl 62 is hingedly carried by pin 68 on the handle 54.

Use and Operation

To use, this pivotally secured handle 54, which is also the trigger release, is moved to the left position and causes said auxiliary head 28 to swing into the condition of FIG. 7. The squeezing of the pivoted handle 54 towards the handle 12 causes the pawl 62 to engage step 66 and push the slide member 60 upwardly. As it is pushed upwardly the auxiliary head 28 swings back and spring 50 is compressed. This backward movement continues as the handle 54 is moved until said handle 54 reaches a release point at which point spring 50, which has been compressed, is released. The torsion spring 64 urges pawl 62 into engagement with step 66 until the handle 54 is moved adjacent to the handle 12 as seen in FIG. 7. At this point the pawl 62 is pulled from in way of the step 66 releasing the slide member 60. The locking of the heads together and the retention of head 28 by bar 110 and locking apparatus 90, 92 and 94 is as above described.

The auxiliary head 28 may be secured in a contiguous relationship to the first head 16 by the U-clip 36 as moved into the aperture 38 shown in FIG. 1. It is to be noted that said U or J-clip 36 may also employ a spring and retainer 121 (FIG. 2 B) to insure that the placed clip remains in place during pounding by a user of the hammer. Also, the rotated lever apparatus 90, 92 and 94 and notch 95 may also be provided with a locking means which may include retaining the lever 90 in its locked or opened condition and position. Also contemplated but not shown is a clip that secures the fixed and movable shank during actuation. Whatever the means or method, the jar or impact force of the auxiliary head against the fixed head 16 is a matter of design as to the embodiment provided.

Terms such as "left", "right", "up", "down", "bottom", "top", "front", "back", "in", "out" and the like are applicable to the embodiments shown and described in conjunction with the drawings. These terms are merely for the purposes of description and do not necessarily apply to the position in which the hammer with the auxiliary swinging head may be constructed or used.

While particular embodiments of said hammer have been shown and described it is to be understood the invention is not limited thereto since modifications may be made within the scope of the accompanying claims and protection is sought to the broadest extent the prior art allows.

What is claimed is:

1. A hammer with a selectively actuated auxiliary head and including:

(a) a handle having a shank portion, said handle adapted for grasping by the user of the hammer;

(b) a first head fixedly secured to the shank portion and having a front face adapted for striking a nail head and the like, said head having a rear face with a surface normal to a line substantially in axial alignment with said fixed head;

(c) a fixed bracket carried at the upper end of the handle grasping portion;

(d) a second auxiliary hammer head fixedly secured to a second shank portion, said second head having a face surface contoured to engage the rear face of the first head;

(e) pivot pin means carried by the fixed bracket and disposed to retain said second shank portion so as to control and guide the swing of the auxiliary head and to permit this second auxiliary head, when moved in an arc established by the pivot means, to engage the rear face surface of the first head to provide further impact and driving force to said first head;

(f) means for limiting the rearward swing of said second auxiliary head, and (g) means for selectively securing said first and second heads to each other in a contiguous relationship so that the driving force is concentrated.

2. A hammer as in claim 1 in which there is provided a detent adapted to engage the lower end of the shank portion carrying the auxiliary head, this detent adapted to restrain the movement of the auxiliary head to a swung open condition until the fixed head strikes the nail and the like whereat the stored force in the spring of the auxiliary head overcomes the detent and the auxiliary head swings forwardly to strike the first head.

3. A hammer as in claim 2 in which the detent is a ball detent.

4. A hammer as in claim 1 in which there is provided a sound and shock absorbing means between the rear face of the first head and the face surface of the second head, this absorbing means carried by and secured to at least one of said heads.

5. A hammer as in claim 1 in which the means for selectively securing the first and second heads to each other in a contiguous relationship is a pin carried in the fixed bracket and adapted for entering an aperture formed in the shank carrying the second head and retaining this auxiliary head in the desired and selected position.

6. A hammer as in claim 1 in which the means for selectively securing the first and second heads to each other in a contiguous relationship is a pivotally retained arc stop which is moved by a lever arm with the distal end of said arm stop moved in way of a shoulder notch in the shank carrying the auxiliary head, this distal end of said lever stop engaging said shoulder notch to retain this auxiliary head in the desired and selected position.

7. A hammer as in claim 1 which further includes a lever which, as it is actuated toward the fixed handle, compresses a first spring and at a determined loading condition of the spring further actuation of the lever toward the fixed handle releases the compressed spring and with the release of said spring actuation rapidly moves the auxiliary head toward and to the fixed head.

8. A hammer as in claim 7 in which one end of the first spring is secured as by a clevis to the lower end of the shank carrying the auxiliary head, the other end of said spring carried by the fixed bracket, said lever pivotally retained by said bracket and biased so that the swinging end of the lever is away from the fixed handle, said lever also carrying a pawl adapted to engage and move a slide member to compress said spring and when released the spring urges and swings the auxiliary head toward and to the first head.

9. A hammer as in claim 8 in which the bias actuating the lever is a torsion spring and the release of the compressed spring includes a pawl which is biased toward and to the slide member which is reciprocally carried in and by the bracket, said slide member having a shoulder which is engaged by the distal end of the pawl and is moved to compressive loading of this first spring with the pawl being moved from in way of said shoulder when and as the lever is brought near to the fixed handle whereat the pawl is disengaged from said shoulder to release said compressed first spring.

10. A hammer as in claim 9 in which the bias means for the pawl movement is a torsion spring.

11. A hammer as in claim 9 in which the slide member is adapted to engage the lower end of the shank carrying the auxiliary head with said slide member engaging said shank end a short distance from the pivot pin means and producing a turning moment around this pivot pin means.

12. A hammer as in claim 11 in which the shank carrying the auxiliary head has an arcuate notch formed therein and there is provided a pivot arm mounted within the fixed bracket, said arm retained in a locked position by a pivotally movable lever lock which is swung to produce a locked and unlocked position and in a locked condition causes the pivot arm and a compatibly formed portion on said pivot arm to engage the arcuate notch in the shank to provide a detent actuation.

13. A hammer as in claim 12 in which the pivot arm also carries a retaining fork member, said fork member when moved with the pivot arm into a locked condition provides means for engaging and preventing the first compression spring from unwanted lever actuation and a swinging movement of the auxiliary head.

14. A hammer as in claim 13 in which there is additionally provided a lever lock pivotally carried by the fixed bracket and with said lever lock having a distal end portion adapted to enter and engage a notch formed in the pivoted shank carrying the auxiliary head, said lever lock when in a locked condition adapted to maintain the heads in a contiguous condition.

15. A hammer as in claim 11 in which the fixed bracket has formed and opposed slots in which a cross bar is slidably carried, this cross bar adapted to be moved to one position whereat the lever actuation is made and when moved to the other position the cross bar restrains compression and the urging movement of said first spring of the auxiliary head.

16. A hammer as in claim 15 in which the cross bar is a wire form and includes a bar portion adapted to engage the first compression spring at its upper end and restrain its compression.

17. A hammer as in claim 16 in which the wire form is made with an extending protrusion which is manipulated to move the cross bar to the desired two limits of movement.

18. A hammer as in claim 15 in which there is additionally provided a spring clip mounted on and carried by the fixed bracket, the spring clip adapted for securing the cross bar at either of its two limits of movement, said spring clip moved to a disengaged condition and position during movement change of the cross bar.

19. A hammer as in claim 18 in which the spring clip is spring biased toward the cross bar so as to engage and retain the cross bar in the selected position.

20. A hammer as in claim 19 in which there is additionally provided a lever lock pivotally carried by the fixed bracket and with said lever lock having a distal end portion adapted to enter and engage a notch formed in the pivoted shank carrying the auxiliary head, said lever lock when in a locked condition adapted to maintain the heads in a contiguous condition.

* * * * *